US007305750B2

(12) United States Patent
Proni

(10) Patent No.: US 7,305,750 B2
(45) Date of Patent: Dec. 11, 2007

(54) METHOD OF ASSEMBLING A LOUDSPEAKER

(75) Inventor: Lucio Proni, Weston, FL (US)

(73) Assignee: JL Audio, Inc., Miramar, FL (US)

( * ) Notice: Subject to any disclaimer, the term of this patent is extended or adjusted under 35 U.S.C. 154(b) by 483 days.

(21) Appl. No.: 10/781,128

(22) Filed: Feb. 18, 2004

(65) Prior Publication Data

US 2005/0180590 A1 Aug. 18, 2005

(51) Int. Cl.
*H04R 31/00* (2006.01)

(52) U.S. Cl. ..... 29/594; 29/592.1; 29/602.1; 29/609.1; 156/73.1; 156/250; 156/267; 156/292; 156/293; 381/113; 381/116; 381/174; 381/191; 381/182

(58) Field of Classification Search ..... 29/592.1, 29/594, 602.1, 609.1; 381/113, 116, 191, 381/174, 182, 186; 156/73.1, 250, 267, 292, 156/293, 297
See application file for complete search history.

(56) References Cited

U.S. PATENT DOCUMENTS 4,336,425 A 6/1982 Renkus ..... 179/115.5 H
4,472,604 A 9/1984 Nakamura et al. .... 179/115.5 R
6,219,431 B1 * 4/2001 Proni ..... 381/397
6,757,402 B2 * 6/2004 Chan ..... 381/396
7,025,170 B2 * 4/2006 Lin ..... 181/171

FOREIGN PATENT DOCUMENTS

JP 355138996 A 10/1980 ..... 29/594
JP 357197999 A 12/1982 ..... 381/404

OTHER PUBLICATIONS

"Microengineered systems for the hearing impaired"; Birch, T.S.; Harradine, M.A.; Stevens, J.C.; Medical Applications of Microengineering, IEE Colloquium on Jan. 31, 1996; pp. 2/1-2/5.*

* cited by examiner

*Primary Examiner*—Paul D. Kim
(74) *Attorney, Agent, or Firm*—GrayRobinson, PA

(57) ABSTRACT

A loudspeaker and method of assembly according to this invention provides for precise alignment between the frame and motor structure before they are connected to one another, and employs a fixture to form the moving assembly of the speaker, i.e. the voice coil, upper and lower suspensions and diaphragm, outside of the frame so that concentric tolerance stack-up is minimized. The moving assembly, once formed, is mounted as a unit to the frame and motor structure to facilitate assembly and repair of the speaker.

15 Claims, 17 Drawing Sheets

METHOD OF ASSEMBLING A LOUDSPEAKER

FIELD OF THE INVENTION

This invention relates to loudspeakers, and, more particularly, to a loudspeaker having field replaceable parts and a method of assembling the loudspeaker.

BACKGROUND OF THE INVENTION

Loudspeakers generally comprise a frame, a motor structure, a diaphragm, a lower suspension or spider and a surround or upper suspension. In one type of speaker, the motor structure includes a permanent magnet sandwiched between a top plate and a back plate, with a pole piece centrally mounted on the back plate so that both the top plate and magnet are concentrically disposed about the pole piece. A magnetic gap is formed between the pole piece and top plate within which a voice coil is axially movable. Preferably, the voice coil consists of a hollow, cylindrical-shaped former having an inner surface and an outer surface which mounts a winding of wire.

The voice coil in speakers of the type described above is mounted within the magnetic gap by the upper and lower suspensions and the diaphragm. One end of the diaphragm is connected to the upper suspension, which, in turn, is mounted to the upper end of the frame. The lower suspension is connected at one end to the frame at a point between its upper and lower ends. The free ends of the diaphragm and lower suspension are mounted to the outer surface of the former of the voice coil and support it for axial movement within the magnetic gap. In many speaker designs, a dust cap is mounted over a central opening formed in the diaphragm so that contaminants are prevented from entering the interior of the speaker.

In the course of operation of speakers of the type described above, electrical energy is supplied to the voice coil causing it to axially move within the magnetic gap. The voice coil, diaphragm, upper suspension, lower suspension, and dust cap, if present, collectively form a "moving assembly" which reciprocates as a unit with the excursion of the voice coil.

The method of fabricating traditional loudspeakers such as noted above involves a process which takes place for the most part within the confines of the frame of the speaker. Initially, the frame is secured by screws, glue or other permanent fasteners to the motor structure. The voice coil is then placed over the pole piece of the motor structure, and a centering gauge is positioned between the voice coil and pole piece. The gap between the voice coil and pole piece, as well as the height of the voice coil within the overall speaker, are set at this stage of the assembly operation with the centering gauge in place.

After the voice coil is positioned relative to the pole piece, the spider or lower suspension is slid along the outer surface of the voice coil, from the top downwardly, until the outer periphery of the lower suspension rests against a spider plateau or seat formed in the frame. When seated, the lower suspension is glued to both the outer surface of the voice coil and to the spider plateau.

Many loudspeaker manufacturers purchase the upper suspension and the diaphragm as a pre-assembled unit from a third party. With the lower suspension in place, the diaphragm of the upper suspension—diaphragm unit is slipped over the voice coil and glued in placed on the outer surface of the former. The outer periphery of the upper suspension is then glued to an upper flange of the frame, and a gasket is attached to such upper flange outside of the upper suspension. Once all the glue has cured, the voice coil gauge is removed from between the voice coil and pole piece by pulling it upwardly through the central opening formed in the diaphragm. A dust cap is then glued to the diaphragm over its central opening.

Beginning with the pole piece of the motor structure, essentially the entire speaker consists of elements which are intended to be oriented in concentric relation to one another. The voice coil is concentric to the pole piece, and the upper suspension, lower suspension and diaphragm are concentric to the voice coil. Each of these elements is made within certain tolerances, and the tolerance "stack-up" or combined total from the voice coil radially outwardly to the upper suspension can be significant. Further, no effort is typically made to obtain fine alignment between the frame and motor structure which can add to tolerance stack-up problems, i.e., the seat or spider plateau in the frame where one end of the lower suspension is mounted, and the upper flange of the frame where the upper suspension is mounted, can be out of concentricity with respect to the pole piece of the motor structure. In most speaker designs, the total concentric tolerance stack-up must be absorbed by the upper suspension. Especially during high excursion of the voice coil, the upper suspension can deform if the tolerance stack-up is too high, causing the voice coil to "rock" or pivot within the magnetic gap. This can severely degrade the performance of the speaker.

Another problem with prior loudspeakers and their method of manufacture involves repairs and warranty work. As noted above, many of the speaker elements are permanently attached together with glue. In the event of a failure of a speaker element, a great deal of time and effort must be expended to clean the surfaces where glue has been applied before a new part can be installed. Generally, it requires skilled workers with special tools to clean part surfaces of glue, apply new glue and assemble new parts within concentricity tolerances. Moreover, expensive, specialized glues are employed in the manufacture of loudspeakers, which are not available to the public. Repairs and warranty work on loudspeakers are therefore typically performed at the factory by skilled workers rather than in the field.

SUMMARY OF THE INVENTION

The loudspeaker and method of assembly of this invention provides for precise alignment between the frame and motor structure before they are connected to one another, and employs a fixture to form the moving assembly of the speaker, i.e. the voice coil, upper and lower suspensions and diaphragm, outside of the frame so that concentric tolerance stack-up is minimized. The moving assembly, once formed, is mounted as a unit to the frame and motor structure to facilitate assembly and repair of the speaker.

One aspect of this invention is predicated upon the concept of simplifying the repair or replacement of elements of a loudspeaker by employing a method of assembly, and a loudspeaker construction, in which the moving assembly of the speaker can be removed and replaced as a unit in the field by an unskilled worker without the use of special tools and without special knowledge of speaker repair. The voice coil, upper and lower suspensions and diaphragm comprise the "moving assembly," which, as described below, is formed as a unit outside of the speaker frame and is then connected to the frame and motor structure using aligning pins and bores formed on the frame, the motor structure and certain elements of the moving assembly. A second fixture is used to connect the frame to the motor structure to ensure precise alignment is obtained between the two before the moving assembly is connected thereto.

In the event of a failure of one of the elements of the moving assembly, which is typically where a problem arises, the entire moving assembly is disconnected from the frame and motor structure and removed. A new moving assembly, fabricated at the factory and shipped as a unit to a retailer or off-site repair center, is then mounted to the frame and motor structure in the field. As noted above, and described below, aligning pins on elements of the moving assembly and bores formed in the frame and motor structure allow for precise alignment of all speaker elements when the moving assembly is replaced without using gauges, guides, fixtures or other special equipment. Additionally, no dust cap is required with the speaker of this invention because the diaphragm may be formed without a central opening.

In addition to the simplification of repairs, the loudspeaker herein and its method of assembly substantially eliminates deformation of the upper suspension even at high voice coil excursions. A centering fixture is employed to precisely align the frame and motor structure before they are secured together. An assembly fixture is used to form the moving assembly which, together with elements of the moving assembly, is machined to precise tolerances to ensure concentric alignment and centering of the voice coil, the upper and lower suspensions and the diaphragm relative to one another as they are interconnected on the assembly fixture. Additional features of this invention further reduce tolerance stack-up among the parts of the moving assembly. As a result, little or no deformation of the upper suspension is required for the voice coil to axially move in concentric relation to the pole piece within the magnetic gap during operation of the speaker.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
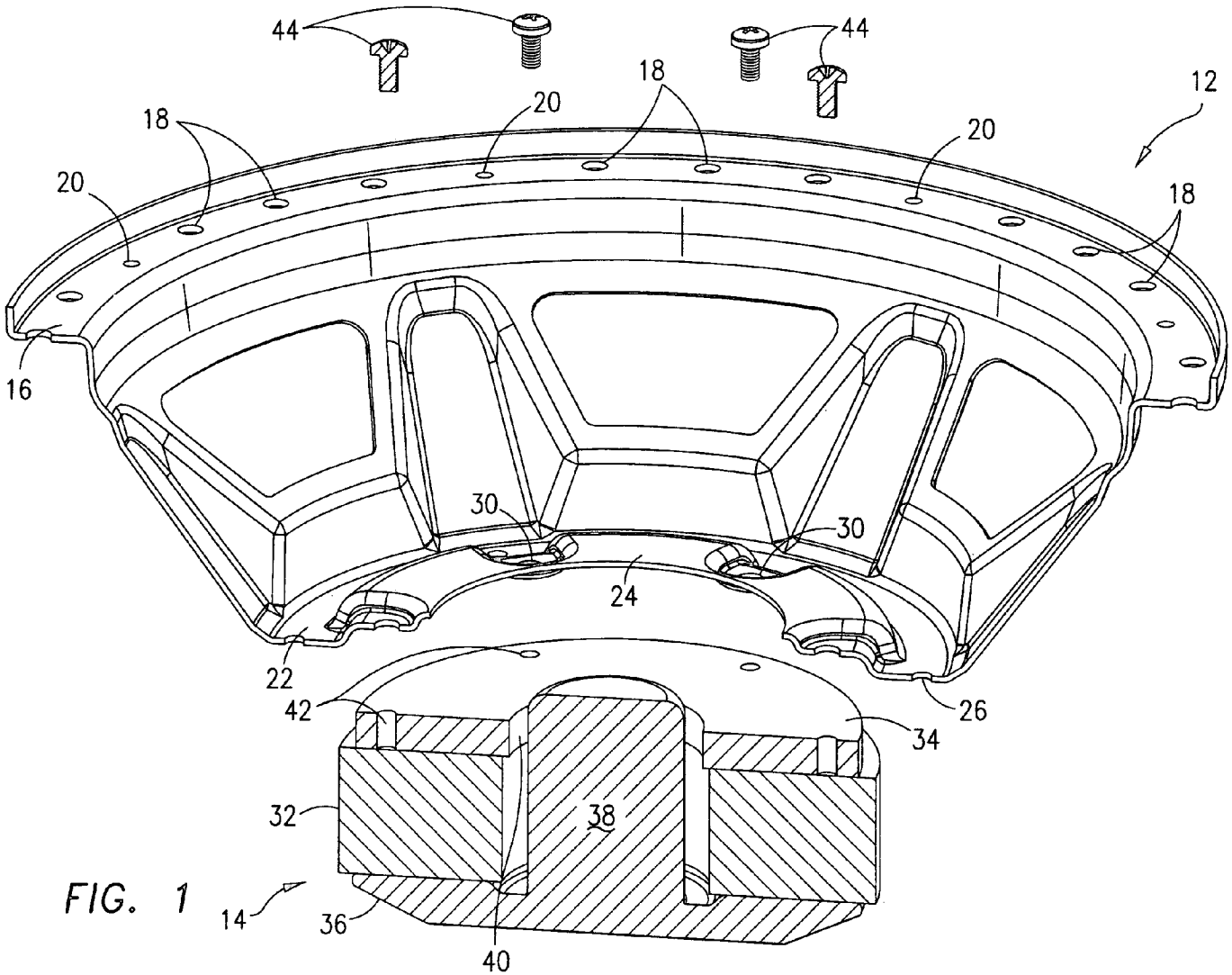
FIG. 1 is an exploded, elevational view, in partial cross section, of the frame and motor structure of the speaker herein.
Figure 2:
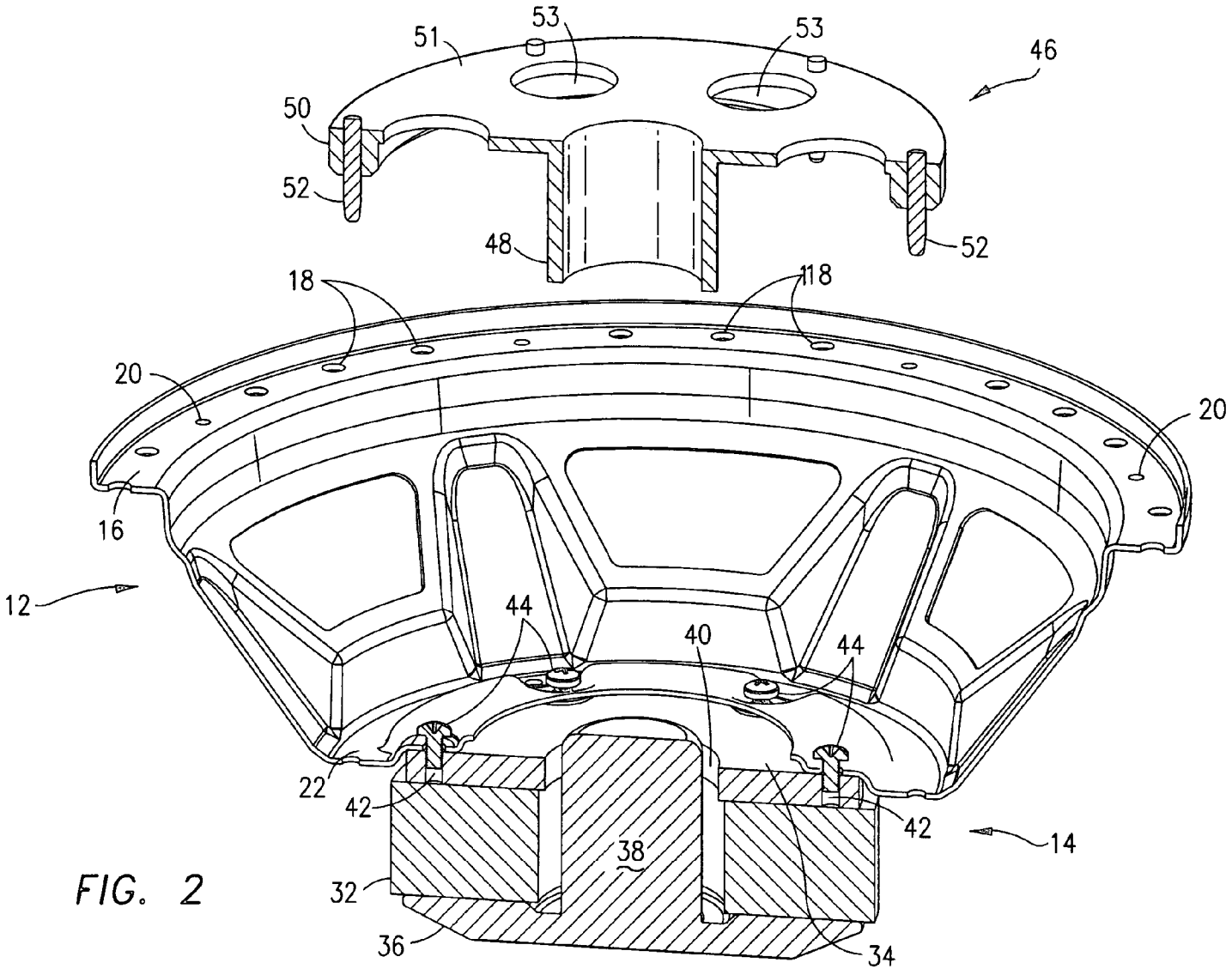
FIG. 2 is a view similar to FIG. 1 except with the frame and motor structure loosely connected to one another, and a centering fixture poised for temporary connection thereto.
Figure 15:
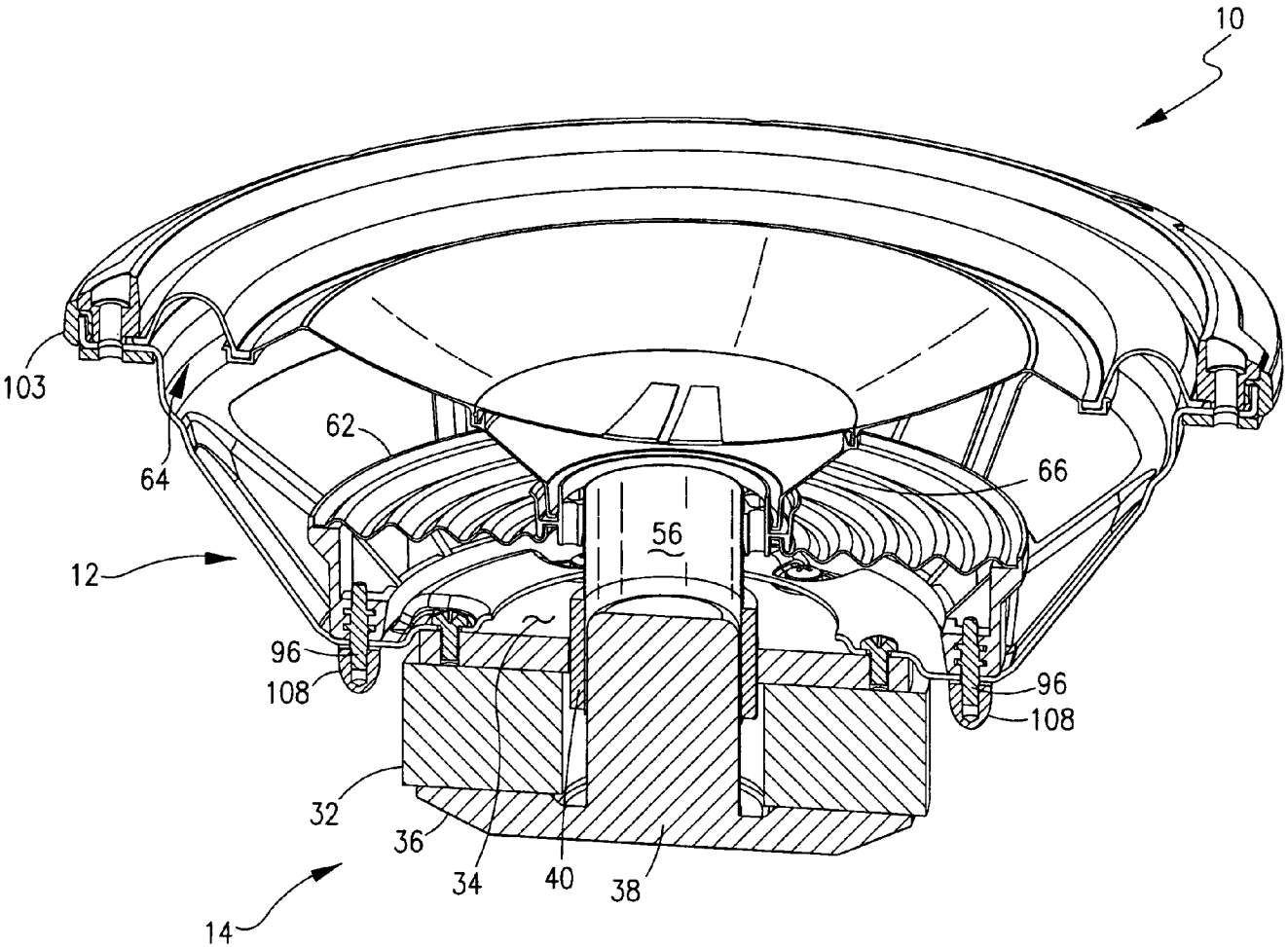
FIG. 15 is a perspective, elevational view, in partial cross section, of the completed loudspeaker of this invention.

Referring now to the drawings, a loudspeaker 10 is illustrated by a series of assembly steps beginning with FIG. 1 and ending with the completed speaker 10 shown in FIG. 15. The structure of speaker 10 will be discussed in the course of describing its assembly, with sequential reference to the FIGS. Throughout the following description, the terms "top," "bottom," "upper" and "lower" are meant to refer to directions and/or locations with the speaker 10 in the orientation shown in the FIGS. The terms "inner" and "outer" refer to a radial relationship of parts or structure beginning at the longitudinal axis of the speaker 10 which, for purposes of this discussion, is considered to pass throughout the pole piece 38, described below.

Assembly of Frame and Motor Structure

With reference initially to FIGS. 1-3 and 15, the speaker 10 has a frame 12 and a motor structure 14. The frame 12 has an upper flange 16 formed with a number of spaced, surround locator holes 18 and a number of spaced, clamp bores 20 in between groups of locator holes 18 as shown. The lower portion of the frame 12 is formed with a lower flange 22 which is integrally connected to a base ring 24. The lower flange 22 has spaced locator holes 26, and the base ring 24 is formed with recessed, mounting bores 30.

The motor structure 14 includes a permanent magnet 32 sandwiched between a top plate 34 and a back plate 36. Both the top plate 34 and magnet 32 are concentrically disposed about a pole piece 38 which extends upwardly from the back plate 36, forming a magnetic gap 40 between the top plate 34 and pole piece 38. Preferably, the top plate 34 is formed with a number of mounting bores 42.

Figure 3:
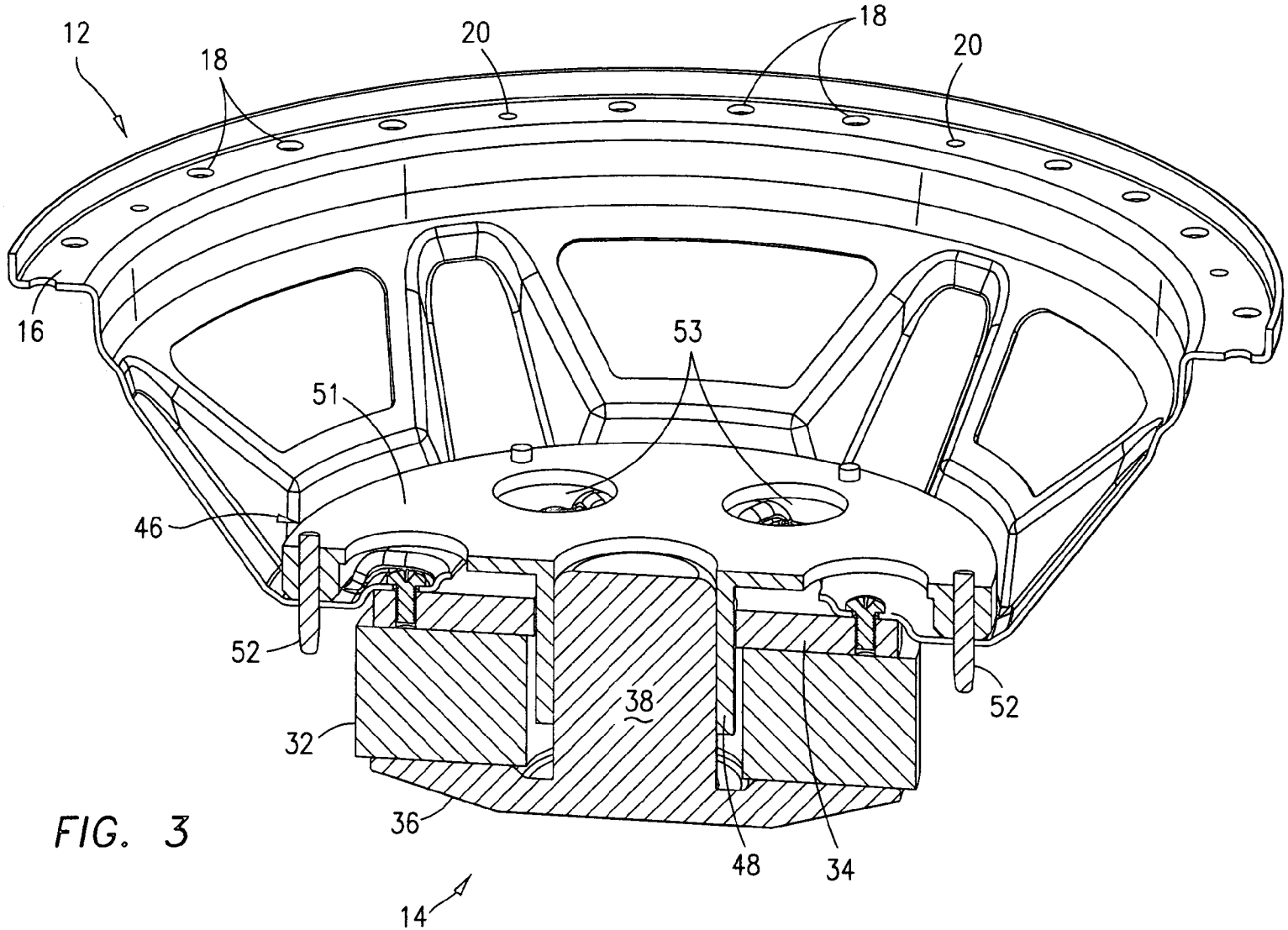
FIG. 3 is a view similar to FIG. 2 except with the centering fixture in place so that the frame and motor structure can be tightly connected.
Figure 4:
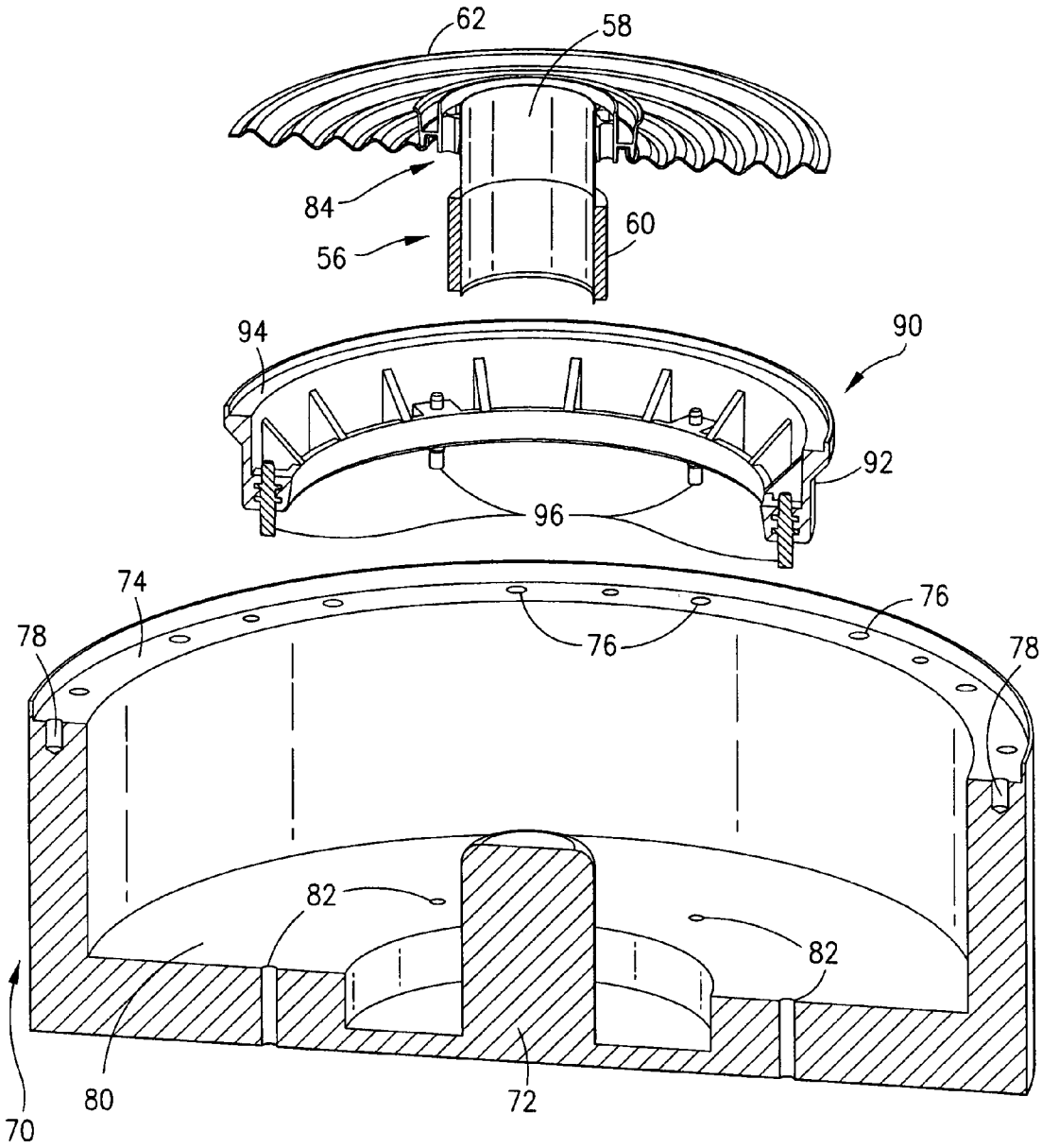
FIG. 4 is an exploded, elevational view, in partial cross section, of the moving parts assembly fixture, the spider standoff and the interconnected voice coil and lower suspension.

The initial step in the assembly method is to place the frame 12 on the motor structure 14 so that the mounting bores 30 in the base ring 24 of the frame 12 align with the mounting bores 42 in the top plate 34 of the motor structure 14. Screws 44 are inserted within the aligning bores 30, 42 but are only loosely threaded therein so that the frame 12 can move relative to the motor structure 14. See FIG. 2. A centering fixture 46 is provided to allow for precise alignment of the frame 12 with the motor structure 14. The centering fixture 46 includes a sleeve 48, an outer ring 50 which supports a number of alignment pins 52 and a top plate 51 having access openings 53. As shown in FIG. 3, the centering fixture 46 is positioned with respect to the frame 12 and motor structure 14 so that the sleeve 48 of the fixture 46 snugly fits over the pole piece 38 of the motor structure 14 and the alignment pins 52 are received within the locator holes 26 in the lower flange 22 of the frame 12. The centering fixture 46 is carefully machined to obtain the desired spatial relationship between the sleeve 48 and alignment pins 52, which, in turn, ensures that the frame 12 and motor structure 14 are radially oriented relative to one another with the centering fixture 46 in place as depicted in FIG. 3. The screws 42 are then tightened down in the aligning bores 30, 42, through the access holes 53 in top plate 51 of fixture 46, to securely mount the frame 12 to the motor structure 14. See FIG. 3.

Fabrication of the Moving Assembly

Referring now to FIGS. 4-11, the steps are illustrated for the fabrication of the "moving assembly" 54 of this invention. The moving assembly 54 refers to the voice coil 56 consisting of a hollow, cylindrical-shaped former 58 whose outer surface receives a wire winding 60, a lower suspension or spider 62, an upper suspension or surround 64 and a diaphragm 66. Each of these elements and their structural relationship to one another is described in more detail below with reference to the assembly steps herein.

A moving parts assembly fixture 70 is provided upon which the moving assembly 54 is formed. The assembly fixture 70 is carefully machined to obtain a precise spatial relationship between its central pole element 72, which corresponds to the pole piece 38 of the motor structure 14, and an outer ring 14 which corresponds to the upper flange 16 of the frame 12. The outer ring 74 of the assembly fixture 70 is formed with a number of spaced surround locator holes 76 and a number of surround fixture holes 78, for purposes to become apparent below. Additionally, the base 80 of the assembly fixture 54 is formed with spider standoff locator holes 82.

Figure 8:
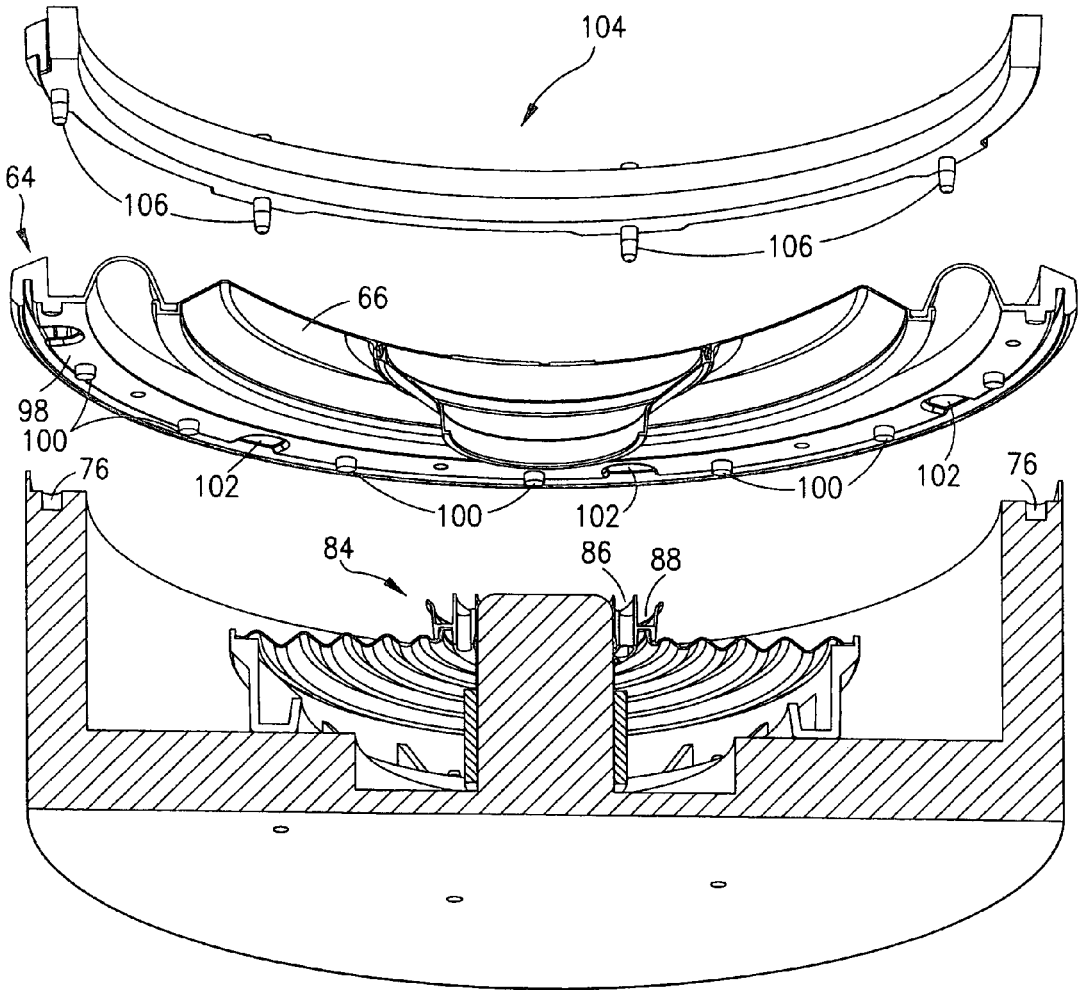
FIG. 8 is a rotated view of FIG. 7 showing the locator pins on the upper suspension and the surround fixture and the construction of the adaptor mounted to the voice coil.

As best viewed in FIG. 8, an adaptor 84 is affixed to the upper end of the former 58 of the voice coil 56. The adaptor 84 is a cylindrical-shaped member having a number of axially extending vent bores 86 and an upwardly facing glue well 88. With the adaptor 84 in place on the voice coil 56, the inner edge of the spider 62 is mounted thereto with glue. The connection of the adaptor 84 to the voice coil 56, and the spider 62 to the adaptor 84, is done in one or more separate operations which form no part of this invention, and are therefore not described in detail herein.

Figure 5:
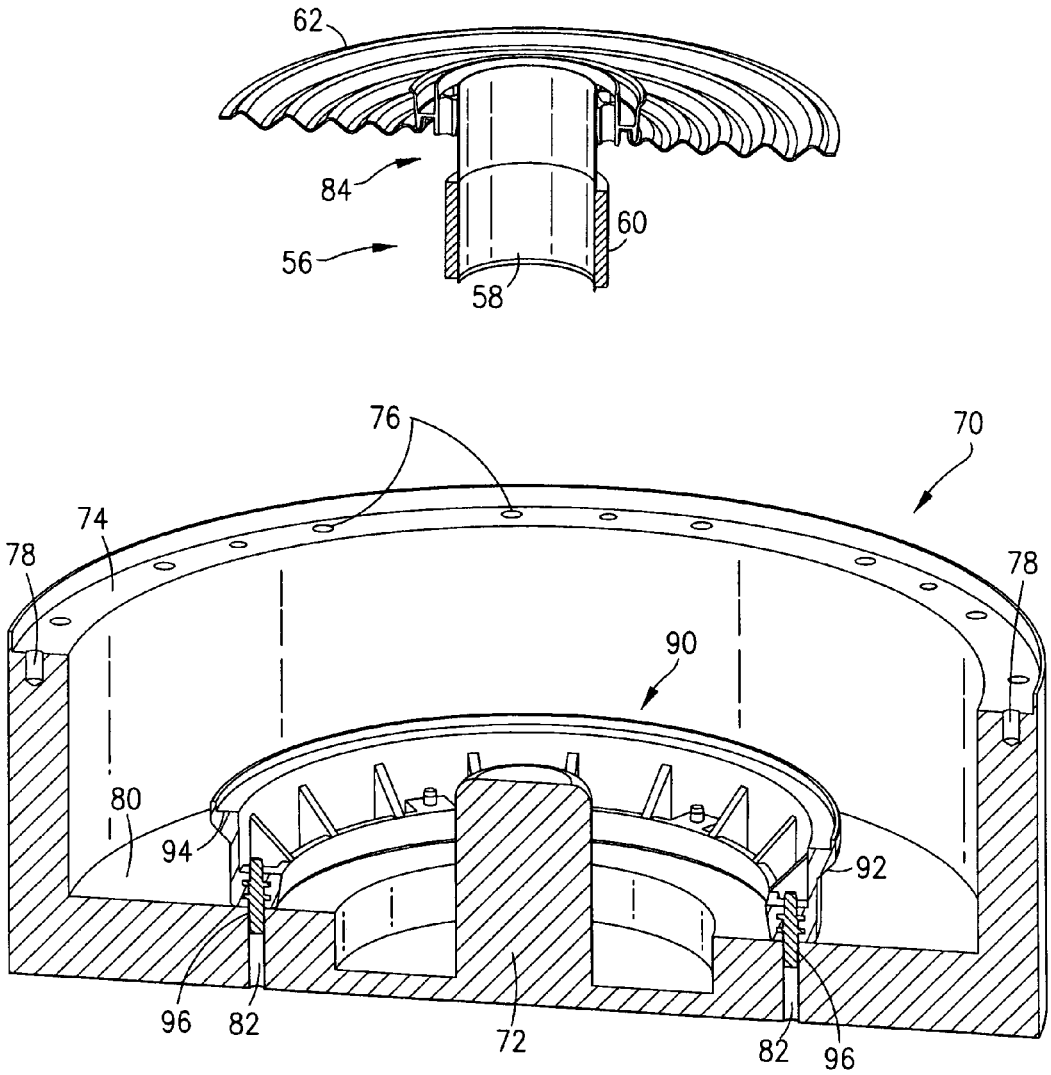
FIG. 5 is a view similar to FIG. 4, except with the spider standoff positioned on the moving parts assembly fixture.
Figure 6:
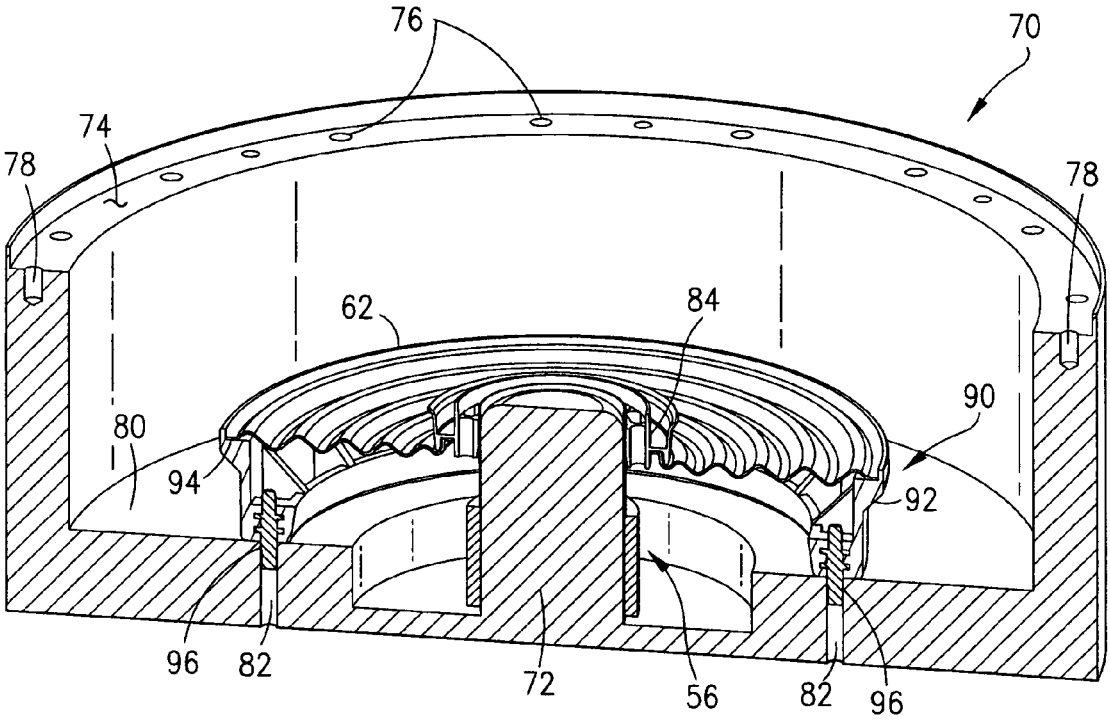
FIG. 6 is a view similar to FIG. 5, except with the voice coil and lower suspension positioned on the moving parts assembly fixture.

In the presently preferred embodiment, the speaker 10 of this invention includes a spider standoff 90 which comprises an annular ring 92 whose upper end is formed with a spider plateau 94 and whose lower end mounts a number of locator pins 96 having a threaded end. Initially, the spider standoff 90 is temporarily secured on the base 80 of the assembly fixture 70 by inserting the locator pins 96 into the spider standoff locator holes 82 in the base 80 of the assembly fixture 70, as illustrated in FIG. 5. With the spider standoff 90 in position, the previously connected voice coil 56 and spider 62 are then placed on the assembly fixture 70 as shown in FIG. 6. The former 58 of the voice coil 56 and pole element 72 of the assembly fixture 70 are precisely formed so that they snugly fit together, thus ensuring proper radial alignment and centering of the outer edge of the spider 62 with the spider plateau 94 of the spider standoff 90. Any tolerance stack-up which may be present in the former 58 of the voice coil 56, the adaptor 84 and the spider 62 is relieved at the spider plateau 94 which permits the outer edge of the spider 62 to "float" or radially move therealong at this stage of the assembly operation. With the voice coil 56 and spider 62 in position as depicted in FIG. 6, the outer edge of the spider 62 is glued to the spider plateau 94.

Figure 7:
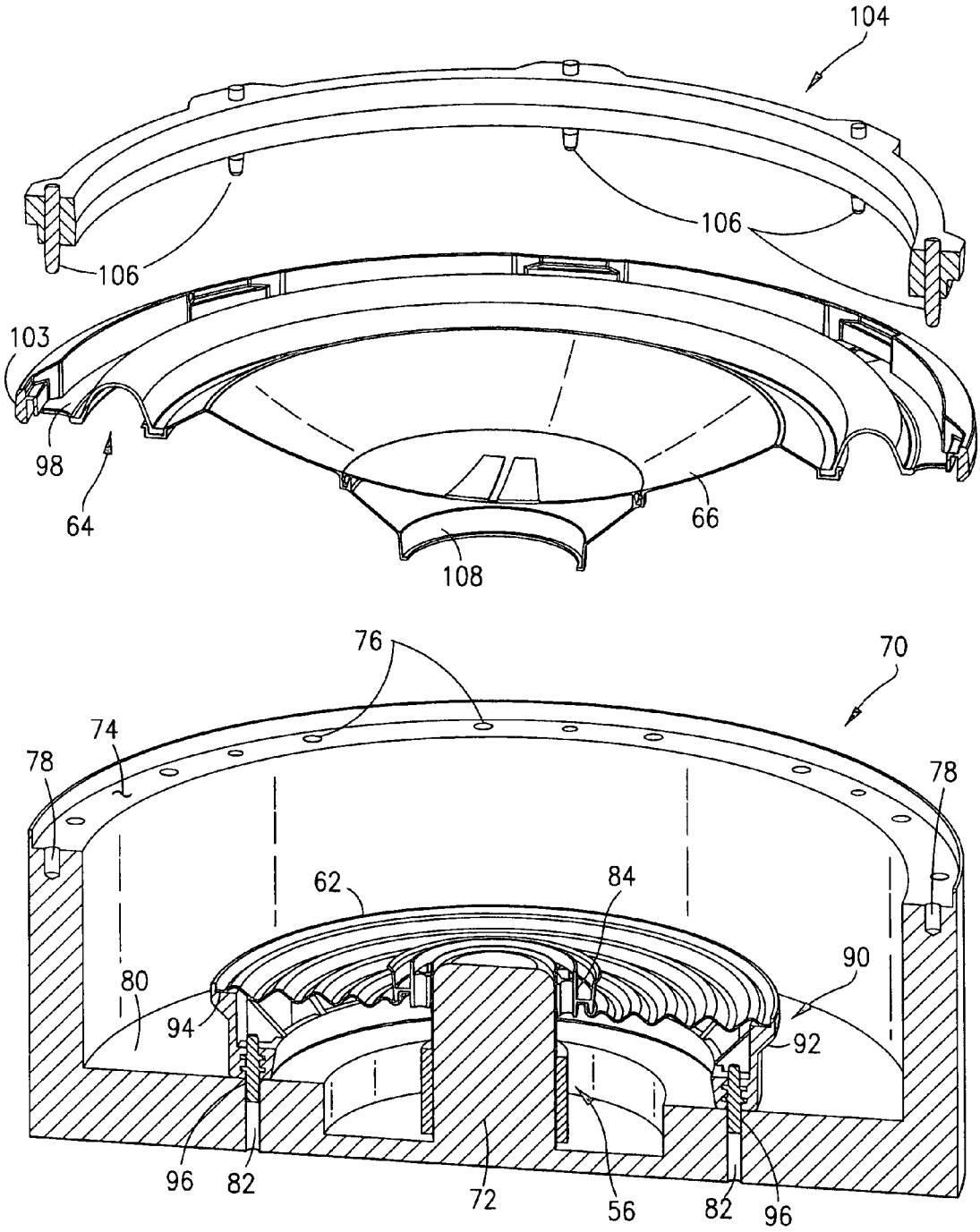
FIG. 7 is a view similar to FIG. 6, except further including a pre-assembled upper suspension and diaphragm, and a surround fixture, shown in position for mounting to the moving parts assembly fixture.

The next step in the method of assembly of the loudspeaker 10 of this invention involves securing the upper suspension or surround 64 and diaphragm 66 to the voice coil 56. In the presently preferred embodiment, the surround 64 and diaphragm 66 are obtained from a third party manufacturer in an assembled condition as shown in FIG. 7. This is typical practice in the industry, and the manufacturers of diaphragms have special fixtures to interconnect them with surrounds to ensure concentricity. The combined surround 64 and diaphragm 66 unit is shipped to the speaker manufacturer per its specifications.

One important aspect of this invention resides in the design of the surround 64 employed in the speaker 10 herein. As best seen in FIG. 8, the surround 64 includes an outer flange 98 formed with a number of spaced, locator pins 100 extending outwardly from its lower surface. The outer flange 98 of the surround is also formed with a number of bores 102 in between the pins 100. Preferably, a gasket 103 is integrally molded at the periphery of the surround 64 to form a one-piece structure.

Figure 9:
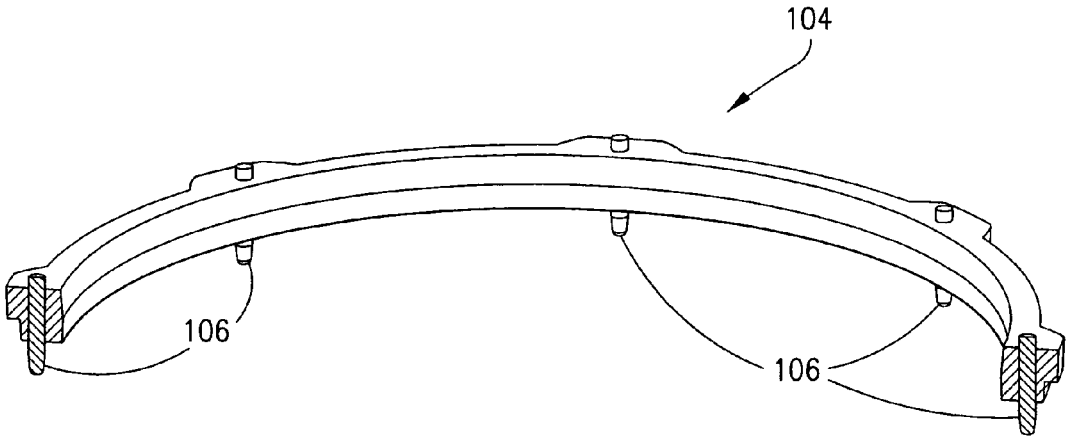
FIG. 9 is a view similar to FIG. 7, except with the upper suspension and diaphragm positioned on the moving parts assembly fixture.
Figure 9:
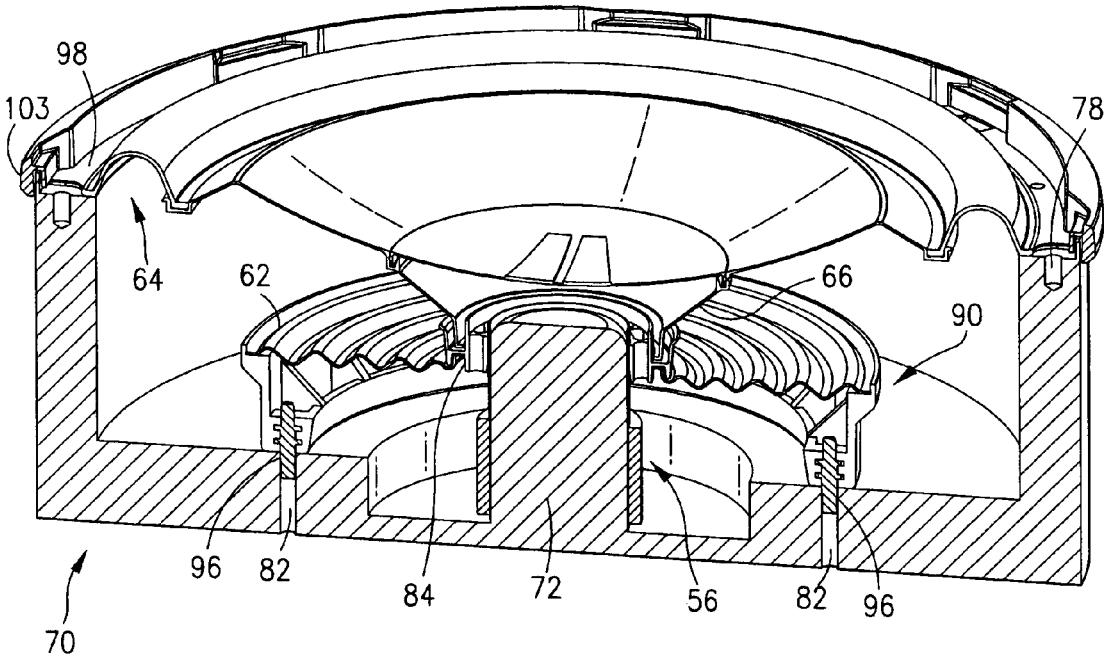

With the voice coil 56, spider 62 and spider standoff 90 in position on the assembly fixture 70, the surround 64 and diaphragm 66 are then placed onto the fixture 70 as depicted in FIG. 9. The locator pins 100 depending from the outer flange 98 of the surround 64 are received within the surround locator holes 76 formed in the outer ring 74 of the assembly fixture 70. The position of the locator holes 76 in the assembly fixture 70 and the pins 100 on the outer flange 98 of the surround 64 is carefully engineered to ensure precise radial alignment of the surround 64 and diaphragm 66 relative to the voice coil 56 and spider 62. The surround 64 and diaphragm 66 are held in this position by a surround fixture 104 whose lower surface mounts a number of locator pins 106. The surround fixture 104 is placed onto the outer flange 98 of the surround 64 with its pins 106 extending through the bores 102 in the outer flange 98 and into the surround fixture mounting bores 78 in the outer ring 74 of the assembly fixture 70. See FIG. 10.

Figure 10:
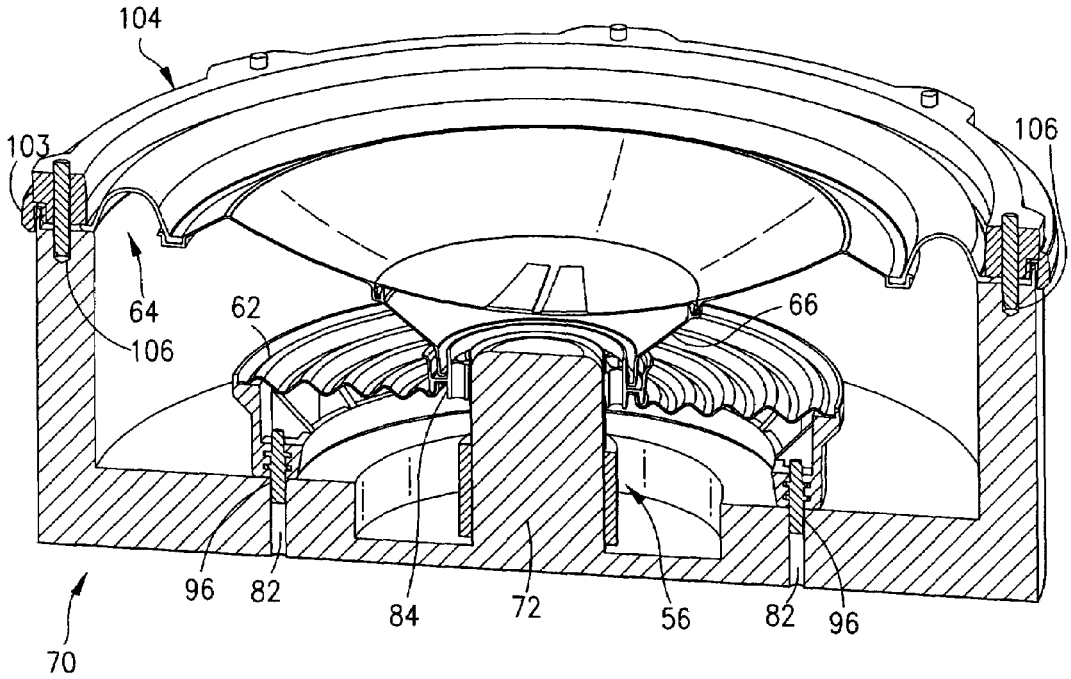
FIG. 10 is a view similar to FIG. 9, except with the surround fixture in position on the moving parts assembly fixture.

As best seen in FIGS. 7 and 10, the lower edge of the diaphragm 66 is formed with an annular foot 108. Upon positioning of the surround 64 and diaphragm 66 onto the assembly fixture 70, the foot 108 of the diaphragm 66 is received within the glue well 88 of the adaptor 84 mounted to the voice coil 56. The glue well 88 is of sufficient radial and height dimension to allow the foot 108 of the diaphragm 66 to move both radially and vertically within the glue well 88. This substantially relieves any tolerance stack-up which may be present in the surround 64, diaphragm 66 or other elements of the moving assembly 54. The glue well 88 is preferably filled with glue before the surround 64 and diaphragm 66 are placed onto the assembly fixture 54 and the foot 108 is placed therein, so that when the surround fixture 104 is mounted to the fixture 54, as noted above, the entire moving assembly 54 is completed and can be set aside for the glue to cure as depicted in FIG. 10.

Although not depicted in the FIGS., it should be understood that wires from the voice coil 56 are connected via leads to an external terminal block, which, in turn, connects to an amplifier.

Final Assembly

Figure 11:
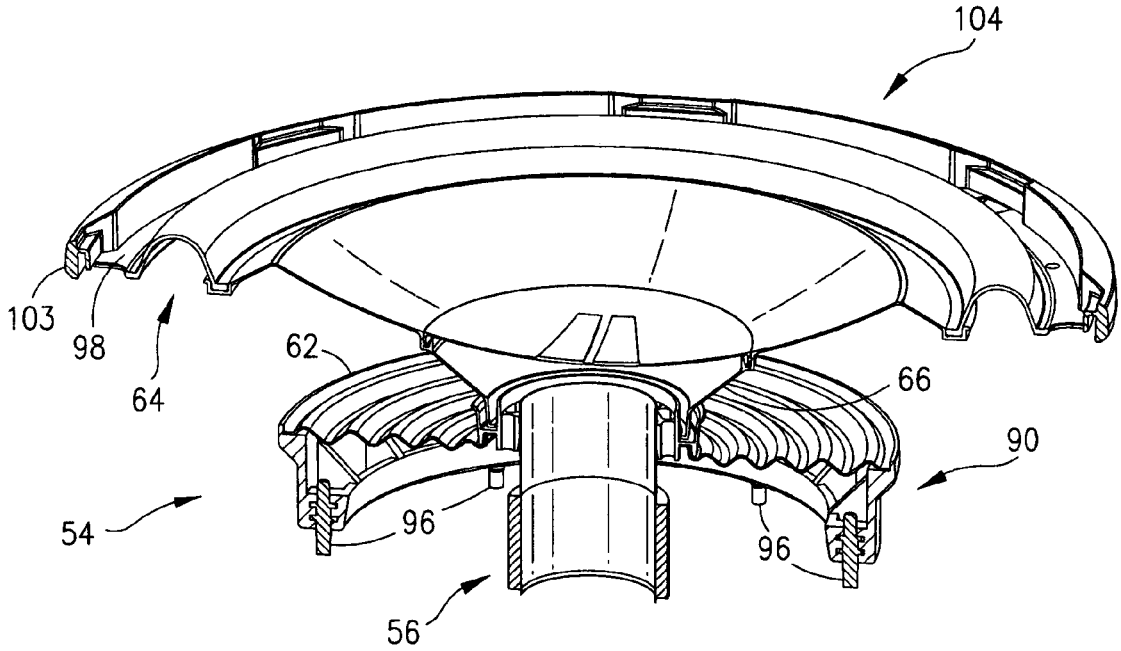
FIG. 11 is an elevational view, in partial cross section, of the completed moving assembly of this invention.
Figure 12:
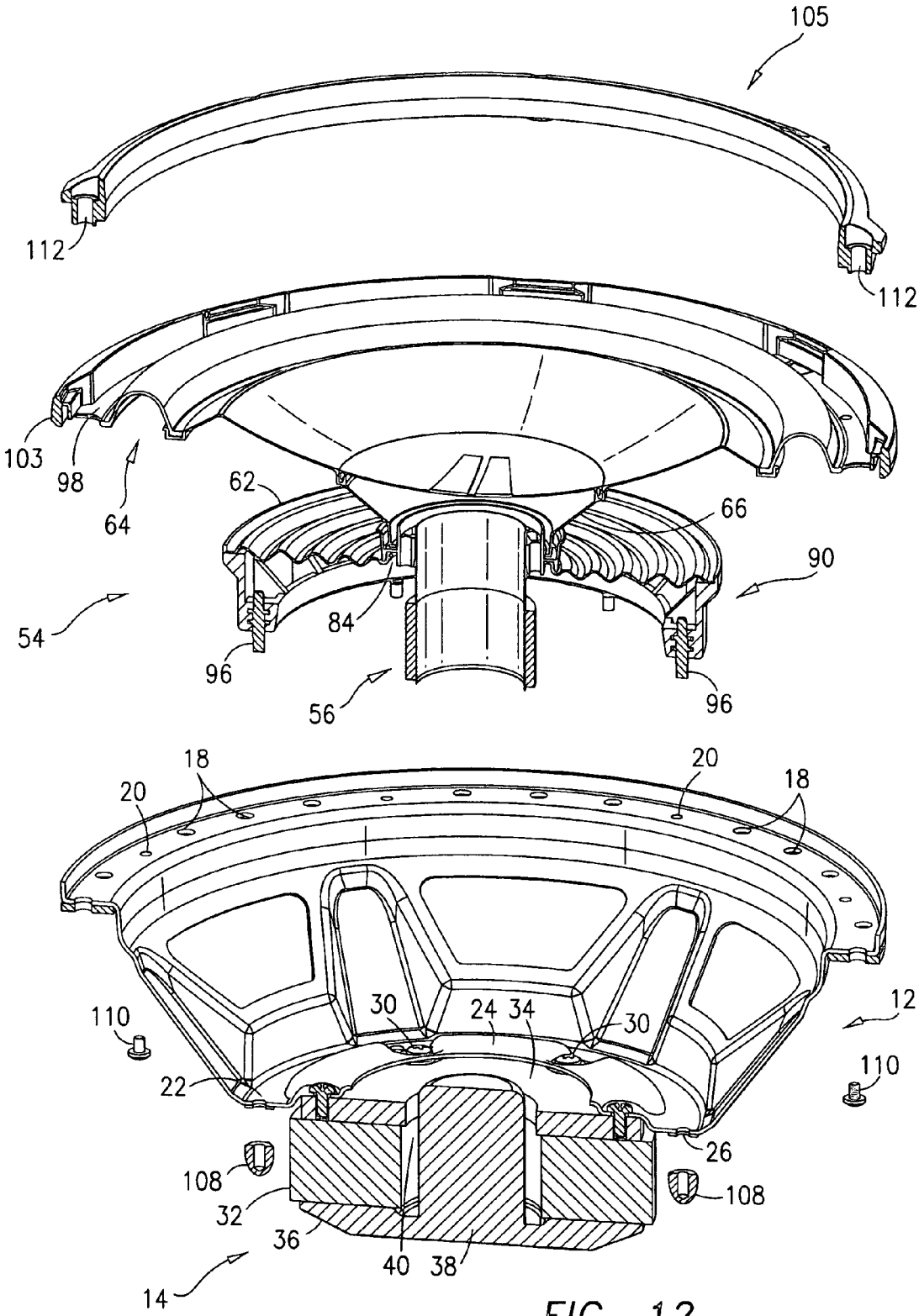
FIG. 12 is a view similar to the combination of FIGS. 3 and 11 depicting the connected frame and motor structure, and the moving assembly and surround clamp in position for mounting thereto.
Figure 13:
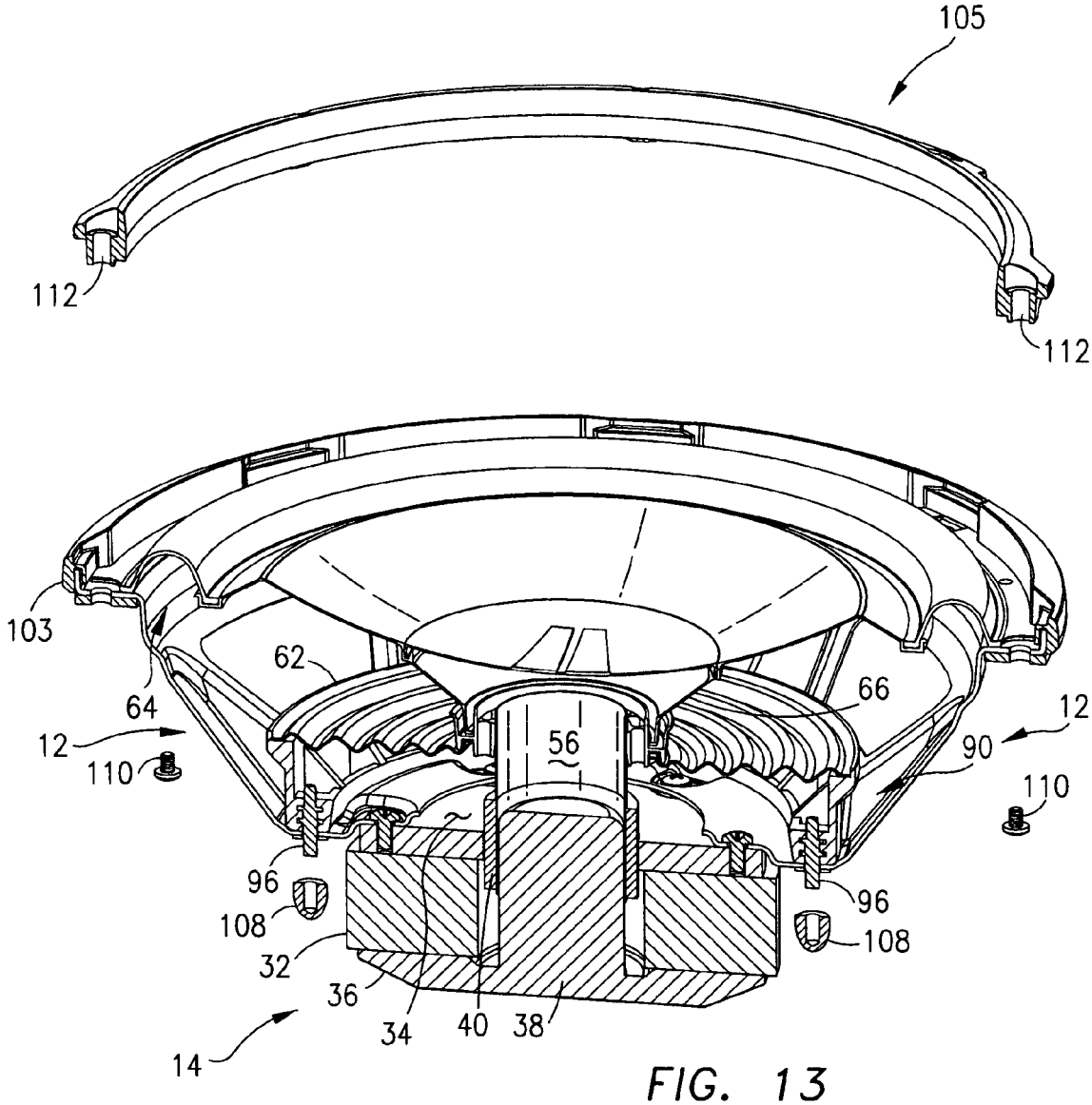
FIG. 13 is a view similar to FIG. 12, except with the moving assembly in position for mounting to the frame and motor structure.
Figure 14:
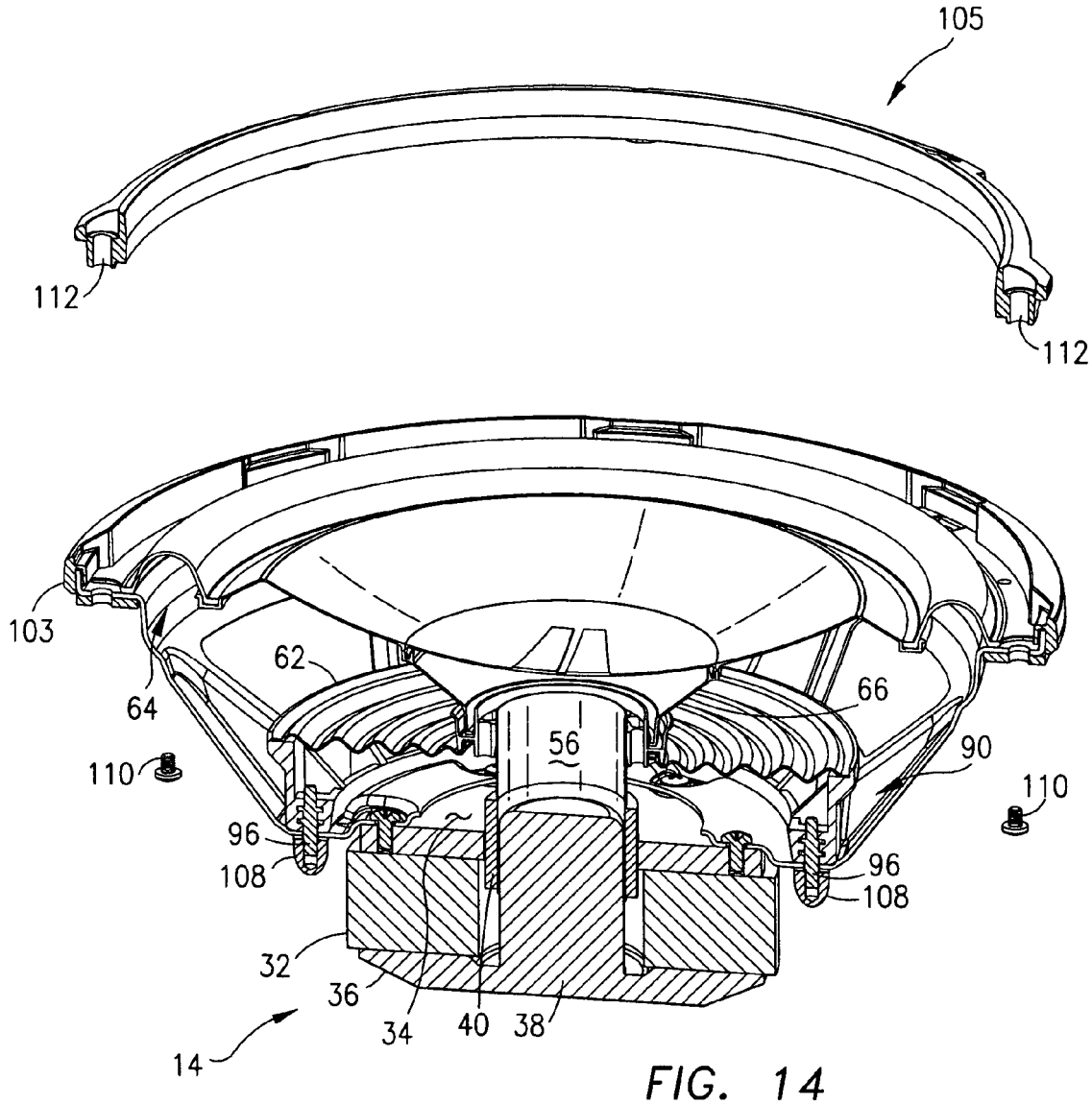
FIG. 14 is a view similar to FIG. 13 showing the nuts and screws used to secure the moving assembly to the frame and motor structure.
Figure 16:
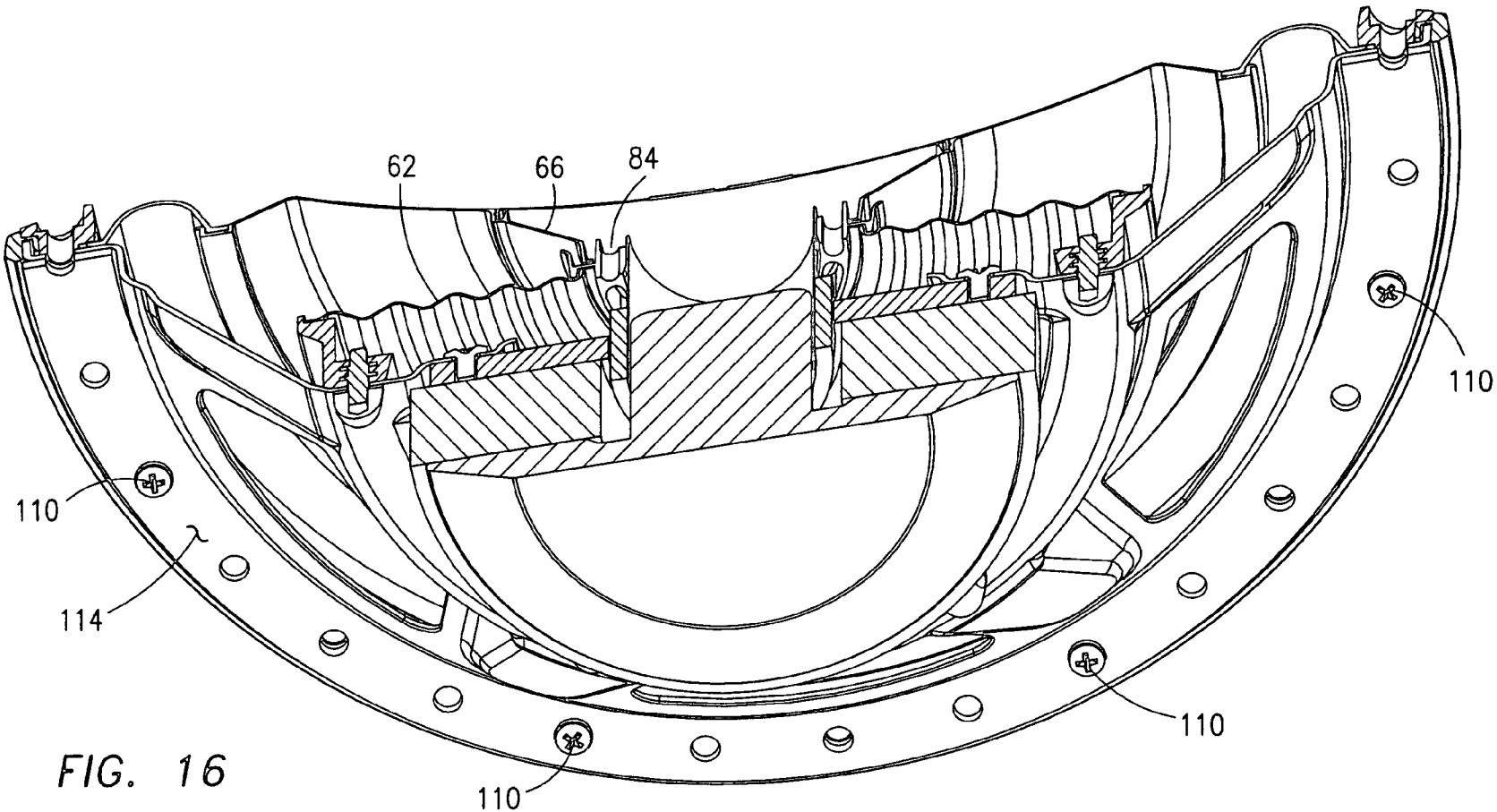
FIG. 16 is a partial bottom view of FIG. 15 depicting the gasket mounted to the underside of the upper flange of the frame.
Figure 17:
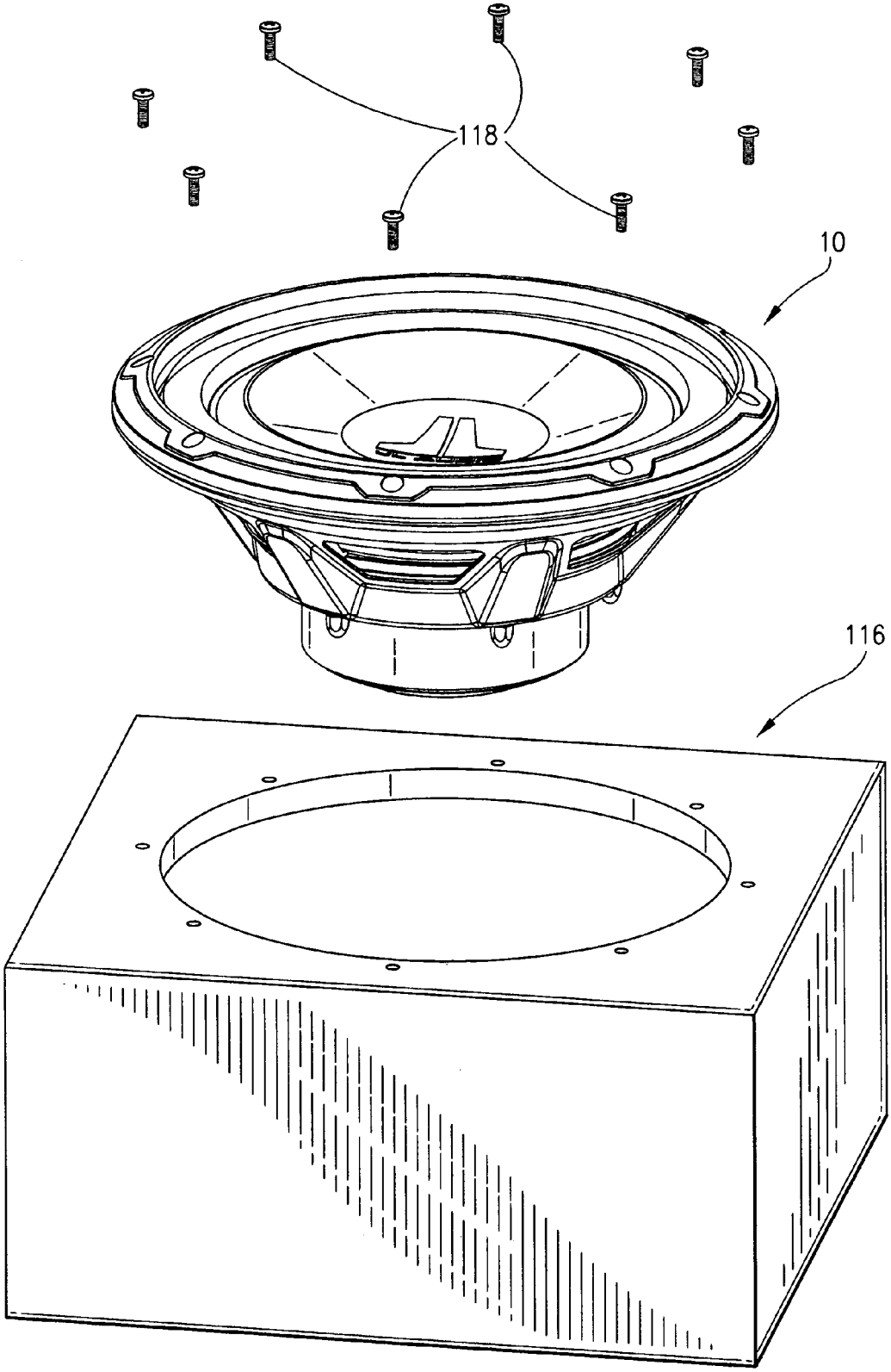
FIG. 17 is a schematic view of the completed loudspeaker of FIG. 15 in position to be mounted to an enclosure.

Referring now to FIGS. 11-17, the method steps of this invention are shown wherein the moving assembly 54 is secured to the frame 12 and motor structure 14 which were previously connected together as described above in connection with a discussion of FIGS. 1-3. The completed moving assembly 54 is shown in FIG. 11, removed from the assembly fixture 70. In FIG. 12, the moving assembly 54 and a surround clamp 105 are illustrated in position above the frame 12 and motor structure 14. The moving assembly 54 is lowered onto the frame 12 so that the locator pins 100 on the underside of the outer flange 98 of the surround 64 are received within the surround locator holes 18 formed in the upper flange 16 of the frame 12. At the same time, the locator pins 96 projecting downwardly from the spider standoff 90 are received within the locator holes 26 formed in the lower flange 22 of the frame 12. The locator pins 96 have threaded ends which receive nuts 108 to tightly secure the spider standoff 90 to the lower flange 22 of the frame 12. The surround clamp 105 is then affixed atop the outer flange 98 of the surround 64, and to the frame 12, by a number of screws 110. These screws 110 extend from the underside of the frame upper flange 16, though the surround clamp bores 20 therein and into threaded bores 112 formed in the surround clamp 105. As shown in FIG. 16, a frame gasket 114 is preferably affixed to the underside of the upper flange 22 of the frame 12 by the screws 110 at the same time the surround clamp 105 is mounted thereto. The completed loudspeaker shown in FIG. 15 is then ready for mounting to an enclosure 116 by screws 118, as schematically depicted in FIG. 17.

The method of this invention provides a number of advantages compared to existing speaker assembly techniques. Unlike many prior art speakers, care is taken initially to ensure there is precise alignment of the frame 12 relative to the motor structure 14 due to the use of the centering fixture 46, as described above. Further, the entire moving assembly 54 is fabricated "outside" of the frame 12, i.e. the voice coil 56, spider 62 and the surround/diaphragm unit are assembled on a separate assembly fixture 70 instead of sequentially connecting them together within the frame as in the prior art. The assembly fixture 70, and features of the speaker elements, particularly the locator pins 100 of the surround 64 and locator pins 96 of the spider standoff 90, ensure precise concentric alignment of the elements of the moving assembly 54. Tolerance stack-up is substantially eliminated by the spider plateau 94 of the spider standoff 70, and the glue well 88 in the adaptor 84 mounted to the voice coil 56.

In the event of a failure of any of the elements of the moving assembly 54, it is a simple matter for the old moving assembly 54 to be removed and replaced by a new one. An unskilled worker with no detailed knowledge of speaker repair or special tools merely needs to remove the screws 110 and nuts 108, and the entire moving assembly 54 can be removed from the frame 12 and motor structure 14. A new moving assembly 54 is then inserted in its place, as noted above.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of assembling a loudspeaker, comprising:

(a) providing a frame having a base formed with a number of spaced mounting holes, a lower flange formed with a number of spaced locator holes and an upper flange formed with a number of spaced surround locator holes;

(b) providing a motor structure having a top plate formed with a number of spaced mounting holes;

(c) aligning the spaced mounting holes in the base of the frame with the spaced mounting holes in the top elate of the motor structure;

(d) loosely securing a number of screws within the aligning mounting holes of the base of the frame and the mounting holes of the top plate of the motor structure;

(e) positioning a centering fixture relative to the frame and the motor structure so that a central sleeve of the centering fixture engages a pole piece of the motor structure, and a number of pins extending from the centering fixture are received within the locator holes formed in the lower flange of the frame;

(f) tightening the screws within the aligning holes in the base of the frame and the top plate of the motor structure;

(g) forming a moving assembly of the loudspeaker as a unit separate from the frame of the loudspeaker; and (h) connecting the moving assembly to the frame and to the motor structure.

2. The method of claim 1 in which step (e) further includes the step of removing the centering fixture from the frame and the motor structure.

3. The method of claim 1 in which step (g) further comprises:

(i) providing an assembly fixture having a pole element, a number of spider standoff locator holes and a frame plateau formed with a number of spaced surround locator holes and a number of spaced surround fixture mounting holes;

(ii) providing a spider standoff having a spider plateau and a number of spaced locator pins; and (iii) providing a surround fixture having a number of spaced locator pins.

4. The method of claim 3 in which step (g) further comprises:

(i) affixing an adaptor to a voice coil, the adaptor having at least one glue well; and (ii) affixing a lower suspension to the adaptor.

5. The method of claim 4 in which step (g) further comprises positioning the spider standoff relative to the assembly fixture so that the spaced locator pins of the spider standoff engage the spider standoff locator holes in the assembly fixture.

6. The method of claim 5 in which step (g) further comprises:

(i) positioning the voice coil over the pole element of the assembly fixture so that the lower suspension engages the spider plateau of the spider standoff; and (ii) affixing the lower suspension to the spider plateau.

7. The method of claim 6 in which said step (i) further includes allowing the lower suspension to move along the spider plateau as the voice coil is positioned over the pole element to relieve tolerance stack up and to ensure concentricity of the voice coil relative to the pole element.

8. The method of claim 7 in which step (g) further includes providing an upper suspension connected to a first end of a diaphragm, the upper suspension having an outer flange formed with a number of spaced surround locator pins and a number of spaced mounting holes, the diaphragm having a second end formed with a foot.

9. The method of claim 8 in which step (g) further includes positioning the upper suspension and the diaphragm onto the assembly fixture so that the foot of the diaphragm is received within the at least one glue well of the adaptor affixed to the voice coil, and the spaced surround locator pins on the outer flange of the upper suspension are received within the spaced surround locator holes in the frame plateau of the assembly fixture.

10. The method of claim 9 in which step (g) further includes positioning the surround fixture onto the outer flange of the upper suspension so that the spaced locator pins of the surround fixture are received by the spaced surround fixture mounting holes in the frame plateau thereby securing the upper suspension and diaphragm to the assembly fixture.

11. The method of claim 9 further including the step of allowing the foot of the diaphragm to move within the at least one glue well of the adaptor to relieve tolerance stack up in the moving assembly, and then affixing the foot of the diaphragm to the at least one glue well.

12. The method of claim 11 in which step (g) further includes removing the moving assembly from the assembly fixture.

13. The method of claim 12 in which step (h) further comprises:

(i) positioning the voice coil over the pole piece of the motor structure;

(ii) inserting the spider standoff locator pins of the spider standoff through the locator holes in the lower flange of the frame; and (iii) inserting the surround locator pins of the upper suspension within the locator holes in the upper flange of the frame.

14. The method of claim 13 in which step (h) further comprises:

(i) positioning a surround clamp onto the outer flange of the upper suspension so that threaded holes formed in the surround clamp align with the mounting holes in the outer flange of the upper suspension and with mounting holes in the upper flange of the speaker frame;

(ii) inserting screws into the aligning mounting holes of the upper flange of the speaker frame, the mounting holes of the outer flange and the threaded holes of the surround clamp to secure the surround clamp to the upper suspension and to the speaker frame.

15. The method of claim 13 in which step (h) further includes threading nuts onto the end of the spider standoff locator pins extending through the locator holes in the lower flange of the speaker frame to secure the spider standoff to the speaker frame.

* * * * *